United States Patent [19]

Mayer et al.

[11] 4,092,959

[45] June 6, 1978

[54] INLET GAS MIXER FOR INTERNAL COMBUSTION ENGINE

[75] Inventors: Edward A. Mayer, Newburgh; Frank V. Sassi, Fishkill, both of N.Y.

[73] Assignee: Texaco Inc., New York, N.Y.

[21] Appl. No.: 450,911

[22] Filed: Mar. 13, 1974

Related U.S. Application Data

[63] Continuation-in-part of Ser. No. 265,107, Jun. 21, 1972, abandoned.

[51] Int. Cl.[2] ..... F02M 25/06

[52] U.S. Cl. ..... 123/119 A

[58] Field of Search ..... 123/119 A

[56] References Cited

U.S. PATENT DOCUMENTS 2,349,675 5/1944 Pratt ..... 123/119 A

*Primary Examiner*—Wendell E. Burns

*Attorney, Agent, or Firm*—Thomas H. Whaley; Carl G. Ries; Robert B. Burns

[57] ABSTRACT

The invention relates to an internal combustion engine into which an exhaust gas recycling system is incorporated. The system includes means to receive air as well as a desired amount of exhaust gas, and to form the two into a preliminary gaseous mixture. The mixture is physically formed within a gas mixer comprising a mixing compartment, into which separate streams of gas and air are concurrently introduced by way of concentrically arranged inlets therefor.

1 Claim, 5 Drawing Figures

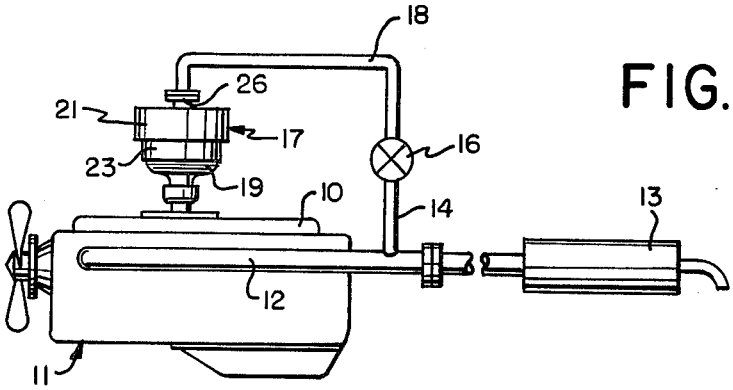
FIG. 1
FIG. 2
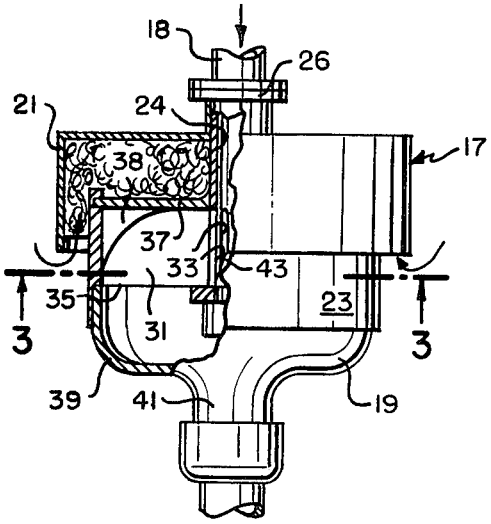
FIG. 3
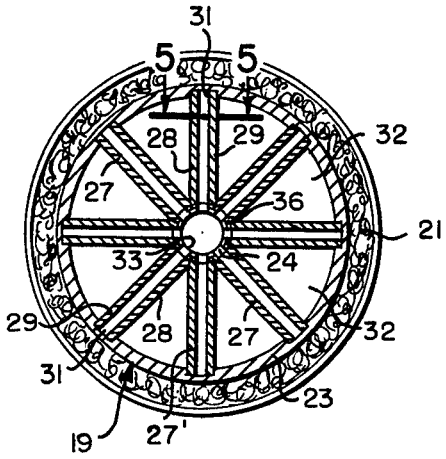
FIG. 4
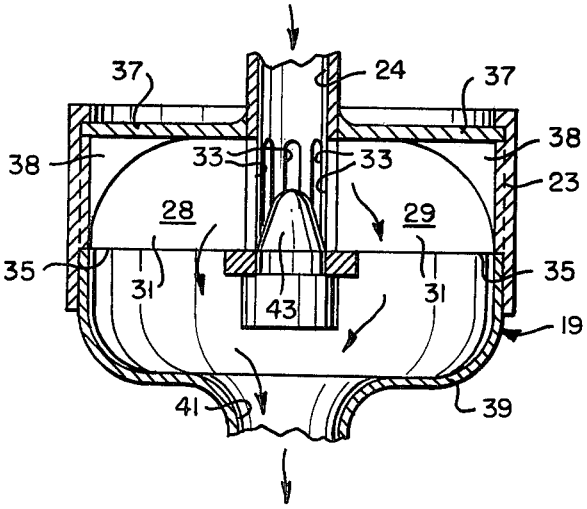
FIG. 5
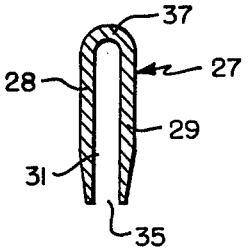

INLET GAS MIXER FOR INTERNAL COMBUSTION ENGINE

The invention herein described was made in the course of, or under a contract or subcontract thereunder, with the U.S. Dept. of Defense.

This is a continuation-in-part of our copending application Ser. No. 265,107 filed on June 21, 1972 now abandoned.

BACKGROUND OF THE INVENTION

A considerable degree of atmospheric pollution occurs through the ordinary burning of a hydrocarbon fuel mix in the normal combustion engine. Various means have been devised however for minimizing the discharge of harmful emissions into the atmosphere from such engines. The concomitant and optimum desire is to operate the engine in a manner such as to fully utilize the fuel burned therein, and yet achieve the desired minimization of harmful discharges.

These atmospheric pollutants comprise among other things, the exhaust or combustion gases. At least one harmful component of said gases is the $NO_x$ component. It has been determined, that to a large extent the degree of $NO_x$ produced by an engine has a direct correlation to the temperature of the exhaust gas. At higher exhaust and gas temperatures, the amount of resulting $NO_x$ is found to be considerably greater than at lower engine operating temperatures.

Toward minimizing the amount of $NO_x$ produced through an engine exhaust gas recycling process, it has been determined that with proper forming of a homogeneous inlet charge, said proportion of exhaust gas can be greatly increased. It is understood however, that under particular engine operating conditions the amount of exhaust gas which can be feasibly utilized in the charge will vary. For example, at higher engine loads, the percentage of exhaust gas recycled is reduced if efficient engine operation is to be realized. On the other hand, at lower and engine idle speeds, said proportion of exhaust gas can be substantially increased.

More specifically, it is known that a recycling of up to approximately 10 percent of the produced exhaust gas will permit an efficient operation of the engine. Beyond this percentage of recycled gas, engine efficiency falls off with the result that the amount of hydrocarbon produced, substantially increases, while the engine output horsepower decreases.

The desired mixing of exhaust gas with atmospheric air to form the homogeneous preliminary charge, is achieved at least in part, through the use of the herein described gas mixing element. Said mixing element receives flows of first and second gases, which will be hereinafter referred to as the exhaust gas and atmospheric air respectively. While other combustion supporting gases can also be utilized in place of atmospheric air or to supplement the latter, the normal engine operation will utilize air as the main ingredient in the combustible mixture.

Functionally, the discrete gases are introduced to a common mixing compartment where they are prompted to form the desired homogeneous mixture. However, the means for introducing said gases includes passage of the exhaust through a plurality of adjacently disposed constricted nozzles. The spaces defined intermediate said respective adjacent nozzles define a plurality of passages for the entrance of atmospheric air.

Thus, the latter is drawn into the mixing compartment along the walls of the adjacently disposed nozzles such that the velocity of the respective air and gas are substantially compatible. Thereafter, upon mixing of the two media, the substantially homogeneous mass will be withdrawn through an exhaust port and directed to the intake side of the combustion chamber for introduction to the latter.

DESCRIPTION OF THE DRAWINGS

FIG. 1 illustrates an internal combustion engine of the type contemplated having a system connected therewith for recycling a portion of the exhaust gas through the instant mixing device.

FIG. 2 illustrates an enlarged view in partial cross section, of the mixing device of FIG. 1.

FIG. 3 is a sectional view taken along line 3—3 in FIG. 2.

FIG. 4 is a segmentary view on an enlarged scale of the mixing device shown in FIG. 2.

FIG. 5 is a cross sectional view taken along line 5—5 in FIG. 3.

Referring to FIG. 1, the present mixing device is carried on and communicated with the intake manifold 10 of a gas engine 11. The hydrocarbon fuel utilized for driving such an engine is normally gasoline, diesel oil or the like. With respect to the instant mixing device, said fuel can be any one of a number of hydrocarbon liquids or even a gaseous fuel.

Further, while the present arrangement provides for the mixing of the introductory gas and fuel within a combustion chamber, the actual mixing of the two into a combustible, atomized fluid can similarly be achieved prior to the passage into the engine combustion chamber.

Engine 11 thus comprises a plurality of combustion chambers which are disposed either in line or in a V configuration depending on the form of engine utilized. In the normal manner, engine 11 is provided with sequentially operated intake and exhaust valves communicated with each combustion chamber. Further, each of said valves, while not specifically shown, is mutually communicated to intake manifold 10, and to an exhaust gas manifold 12 respectively.

Toward illustrating the instant invention, the type of injection into the engine combustion chamber, will be such that the gaseous preliminary charge and the fuel, are ignited in a manner described in U.S. Pat. No. 2,484,009.

In said patent the unique engine operation includes the introduction of an air charge to the intake valve, and the forced submission of the air into a generally swirling fluid mass. A combustible fuel such as gasoline, is thereafter separately introduced into the combustion chamber to combine with a portion of the swirling air mass. The localized combustible mixture is then ignited.

Combustion of the mix takes place in the immediate vicinity of a spark plug, which in turn is ignited in the usual manner through an ignition system timed to operate in cooperation with the running of the engine.

The instant engine as noted, includes intake manifold 10 which is communicated with the various cylinder intake valves. Discharge, or exhaust manifold 12 is similarly communicated with the exhaust valves to receive pulsed flows of exhaust gas from the combustion chambers. The hot exhaust stream is then directed through a muffler 13. However, to operate the engine utilizing recycled exhaust gas, said exhaust manifold 12 is communicated with an exhaust gas conduit 14.

Flow through the latter is regulated by means of valving 16 arranged within the conduit 14. Said latter mentioned valve or valve system is operated either manually or automatically by means responsive to the engine conditions, whereby to regulate or control the amount of exhaust gas recycled.

The overall process of recycling a portion of the exhaust gas for introduction to the upstream side of the engine is a known technique. However, the volume of exhaust gas recycled has always been limited due to the want for suitable means to adequately mix air and recycled gas as to obtain a satisfactory combustible mix.

Referring to FIG. 1, the downstream side of the flow regulating valve 16 is communicated with the gas mixing device 17 by line 18. The latter is communicated through a nozzle assembly to be hereinafter described, and thereafter to a mixing compartment 19 in gas mixer 17. The latter is similarly communicated with a filter element 21 such that incoming air is segregated into a number of discrete streams prior to introduction thereof to the mixing operation in compartment 19.

The downstream side of said mixing device 17 is communicated with intake manifold 10 or directly with the respective intake valves.

In normal engine operation, hot exhaust gas entering exhaust manifold 12 will be at a temperature between approximately 600° and 1700° F. As herein noted, it is desirable to recycle as much of this exhaust stream as practically feasible without substantially upsetting overall operation of the engine. Mixing device 17, wherein the first and second gaseous streams are homogenized into the desired condition, comprises in essence a shroud ring or casing 23 which forms a continuous circular wall having opposed ends. A central gas conduit 24 is disposed within said ring, preferably in coaxial alignment with the ring whereby to form an essentially concentric relationship therewith.

Central conduit 24 comprises a tubular or pipe-like member which extends beyond the edge of ring 23, and functions as an inlet port 26 for connection to the exhaust gas conduit 18. Said conduit 24 is generally cylindrical in configuration and extends into the gas mixing compartment 19 a sufficient distance to support the respective gas carrying nozzles 27 which make up the nozzle assembly.

Said nozzles 27 and 27' comprise in effect an elongated relatively flat member, having parallel external walls 28 and 29 which define a passage 31 therebetween. The upper end of the respective nozzle walls 28 and 29 are disposed in abutting engagement with the inner surface of shroud ring 23 to form a top closure to the nozzle passage 31.

The respective nozzles 27 as shown, are radially arranged and communicated with, and connected to the central conduit 24 in a manner that the plurality of nozzles extend outward an equidistance from said conduit surface. The lower end of the respective nozzle walls 28 and 29 define inlet port 33 which registers within a receiving slot 36 of conduit 24. These series of slots thus provide a means for dividing the continuous gas flow through passage 26 through a plurality of discrete gas streams. The nozzle rear wall 37 connects the opposed side walls 28 and 29 and is preferably smoothly curved along its outer surface to best receive incoming air and to distribute the latter into discrete streams.

To minimize flow turbulence within nozzle 27 the latter can be provided with a flow guide insert 38. The latter is positioned internally of the nozzle between the respective walls, and is so curved to direct incoming gas streams toward nozzle outlet 34.

Referring to FIG. 3, each adjacent pair of nozzles 27 and 27' defines therebetween air flow passage 32 which receives air from filter 21, segregates the latter into discrete air streams prior to introduction thereof to compartment 19. Each nozzle 27 is further provided along its rear edge with a relatively thin wall which is disposed substantially radially with respect to said gas mixing compartment 19, and terminates in outlet 34.

The radial and equispaced circular arrangement of the respective nozzles 27 and 27' then, is such as to receive a single flow of exhaust gas through conduit 24. Said single flow is thereafter distributed substantially equally among the respective nozzle inlet apertures 33.

The downstream side of the mixer 17 is provided with a closure plate 39 having a curved inner surface which defines a wall of mixing compartment 19. Said closure plate permits the exhaust gas exiting from nozzles 27, as well as the respective streams of air entering the compartment, to impinge thereagainst, be directed toward the center of mixing compartment 19, to properly mix and be discharged through port 41 as a homogeneous flow. The condition of the air and gas streams are thus changed from a relatively laminar flow, into a turbulent condition thereby prompting homogeneity of the mixture.

Discharge port 41 of the mixing compartment 19 is communicated through a suitable conduit or throttling means, to intake manifold 10 of engine 11.

Conduit 24 is further provided with a convex air deflecting surface 43. The latter is disposed centrally of the mixer and interposed within conduit 24, in such a manner as to direct the stream of gas passing through the latter in an outward direction toward the slots 33.

As noted above, the downstream side of mixing device 17 can be further provided with a gas throttling arrangement adjusted to regulate the combined gaseous flow from mixing compartment 19. In any event upon sequential actuation of the respective cylinder intake valves, a predetermined amount of preliminary gas mix will be drawn from said intake manifold 10 and introduced to a combustion chamber. Within the latter, a measured amount of liquid fuel is injected into the rapidly entering, swirling mass of gas, forming a localized combustible portion in the vicinity of the engine spark plug.

Other modifications and variations of the invention as hereinbefore set forth may be made without departing from the spirit and scope thereof, and therefore, only such limitations should be imposed as are indicated in the appended claims.

We claim:

1. In combination with an internal combustion engine having intake and exhaust manifolds, an exhaust gas recycling system incorporated in said engine to recycle a portion of exhaust gas from said exhaust manifold whereby to intermix with air to form a homogeneous preliminary gaseous mixture for introduction to said engine intake manifold, a gas mixer (17) in said gas recycling system adapted to receive flows of said exhaust gas and air respectively, and to form said preliminary gaseous mixture, said gas mixer comprising, an elongated casing defining a circular gas mixing compartment (19) having opposed ends, inlet means for exhaust gas and air disposed transversely on one end of said elongated casing, an impinging wall (39) positioned at the casing opposed end against which air and exhaust gas streams impinge prior to leaving said mixing compartment (19), means forming a discharge port (41) opening into said gas mixing compartment (19) and communicated with said engine intake manifold to conduct said preliminary gaseous mixture to the latter, said inlet means for exhaust gas including a conduit (24) communicated with said mixing compartment (19) and with said engine exhaust manifold respectively to conduct a stream of exhaust gas from the latter and, a plurality of nozzles (27) communicated with said conduit (24), being circularly arranged about the latter and having discharge slots (35) extending from said conduit (24) radially outward to the wall of said casing, whereby to define between adjacent nozzles, intermediate passages communicated with a source of air, said conduit (24) includes an internal deflecting surface (43) at the conduit end, and openings (33) formed in the conduit wall adjacent to said deflecting surface to communicate said nozzles (27) with said conduit.

* * * * *